US006079618A

United States Patent [19]

Hedberg et al.

[11] Patent Number: 6,079,618

[45] Date of Patent: Jun. 27, 2000

[54] OPENING ARRANGEMENT FOR PACKAGING CONTAINERS

[75] Inventors: Peter Hedberg, Lund, Sweden; Lars Jönsson, Dallas, Tex.; Gian Luca Furini, Castelfranco Emilia; Mauro Morandi, Modena, both of Italy

[73] Assignee: Tetra Laval Holdings & Finance S.A., Pully, Switzerland

[21] Appl. No.: 09/171,223

[22] PCT Filed: Apr. 8, 1997

[86] PCT No.: PCT/SE97/00582

§ 371 Date: Jun. 15, 1999

§ 102(e) Date: Jun. 15, 1999

[87] PCT Pub. No.: WO97/38910

PCT Pub. Date: Oct. 23, 1997

[30] Foreign Application Priority Data

Apr. 16, 1996 [IT] Italy ..... MI96A0722

[51] Int. Cl.[7] ..... B65D 5/72

[52] U.S. Cl. ..... 229/125.15; 229/125.04; 229/123.2; 220/254; 220/255; 220/258; 220/277

[58] Field of Search ..... 220/258, 277, 220/279, 255, 254; 229/125.14, 125.15, 125.04, 125.05, 123.2, 125.09

[56] References Cited

U.S. PATENT DOCUMENTS

| | | | |
|---|---|---|---|
| 1,816,835 | 8/1931 | Fischer | 229/204 X |
| 3,883,034 | 5/1975 | Rausing . | |
| 4,059,201 | 11/1977 | Foster | 220/258 |
| 4,113,103 | 9/1978 | Carlsson . | |
| 4,126,263 | 11/1978 | Mårtensson . | |
| 4,175,528 | 11/1979 | Kjelgaard et al. . | |
| 4,197,949 | 4/1980 | Carlsson . | |
| 4,258,876 | 3/1981 | Ljungcrantz . | |
| 4,792,069 | 12/1988 | Nantin et al. . | |
| 4,819,839 | 4/1989 | Carlsson et al. . | |
| 4,934,590 | 6/1990 | Robichaud et al. | 229/125.14 |
| 5,069,372 | 12/1991 | Kawajiri | 229/123.2 X |
| 5,103,973 | 4/1992 | Sato | 220/258 X |
| 5,364,019 | 11/1994 | Björck et al. . | |
| 5,484,101 | 1/1996 | Hedberg . | |
| 5,495,706 | 3/1996 | Björck et al. . | |
| 5,620,550 | 4/1997 | Andersson et al. . | |
| 5,875,958 | 3/1999 | Weiteder et al. | 229/125.04 X |

FOREIGN PATENT DOCUMENTS

| | | |
|---|---|---|
| 0 658 480 | 12/1994 | European Pat. Off. . |
| 0 558 946 | 4/1997 | European Pat. Off. . |

*Primary Examiner*—Stephen P. Garbe
*Assistant Examiner*—Tri M. Mai
*Attorney, Agent, or Firm*—Burns, Doane, Swecker & Mathis, L.L.P.

[57] ABSTRACT

An opening arrangement for packaging containers which is manufactured from a flexible packaging laminate and includes a prefabricated outlet opening which is covered by a tear-off strip or pull-tab. To facilitate pouring of the contents and permit reclosure of the packaging container, the container also displays a prefabricated pouring device surrounding the outlet opening, the pouring device being applied on the outside of the packaging container and comprising a reclosable lid. In order to ensure satisfactory function and facilitate application of the pouring device onto the packaging container, the pull-tab extends, according to the present invention, in beneath the pouring edge of the pouring device and is fixedly sealed between the pouring device and the upper side of the packaging container. The fixedly sealed part of the pull-tab is disposed to be separated from he remainder of the pull-tab by means of a tear device located in the pouring device, the tear device optionally including teeth for tearing off the pull-tab in connection with the opening of the packaging container.

18 Claims, 4 Drawing Sheets

Fig. 2A
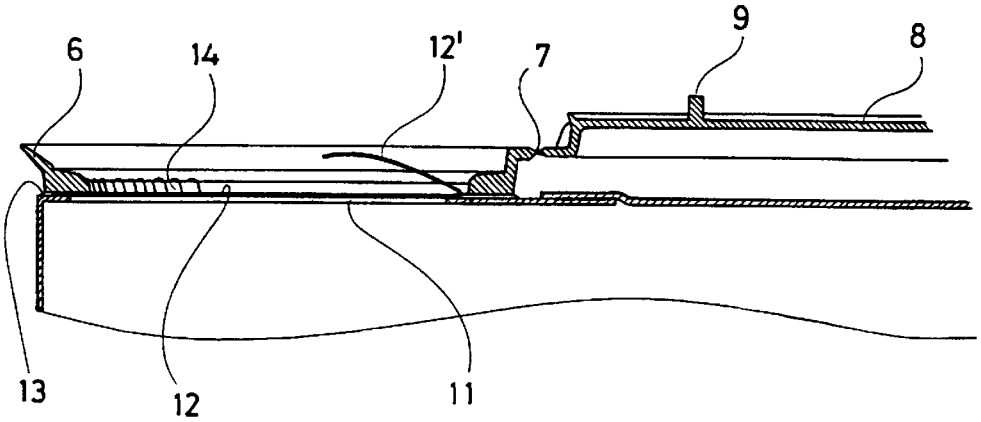
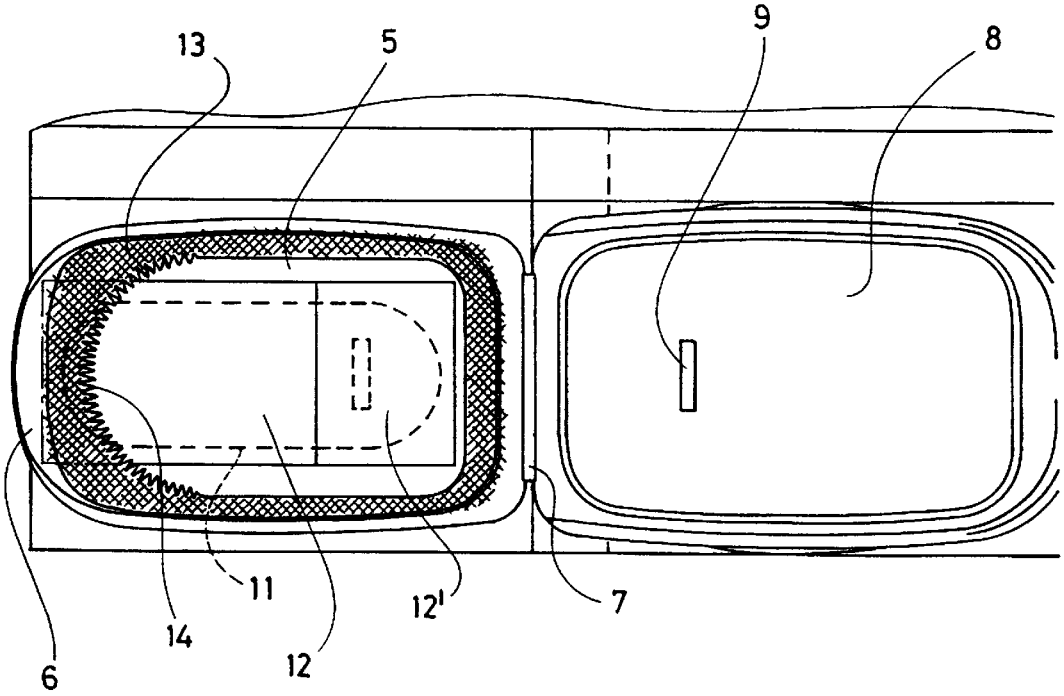
Fig. 2B

Fig. 3A
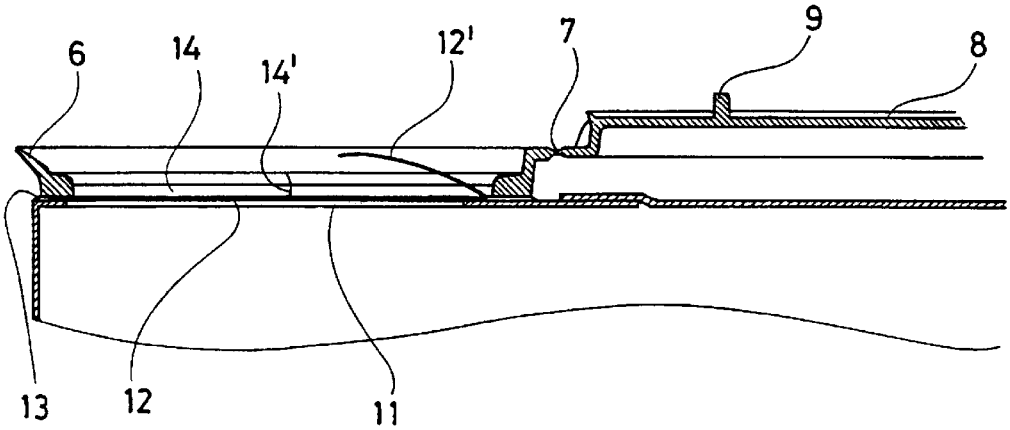
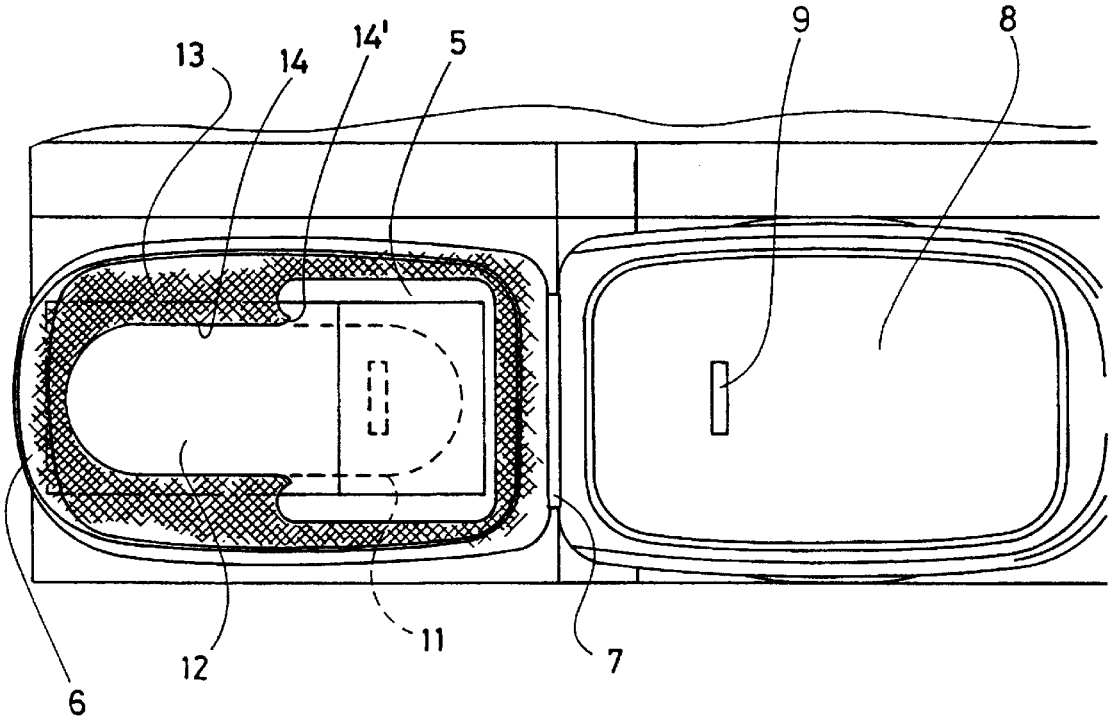
Fig. 3B

Fig. 4 A
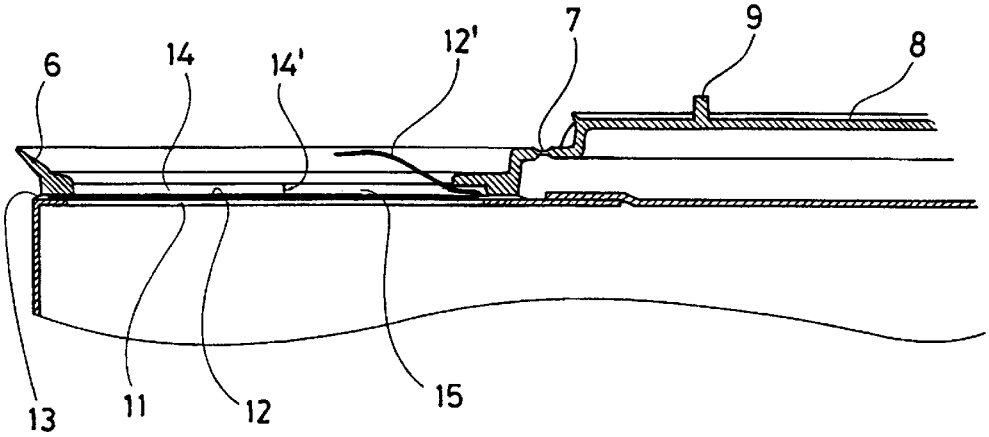
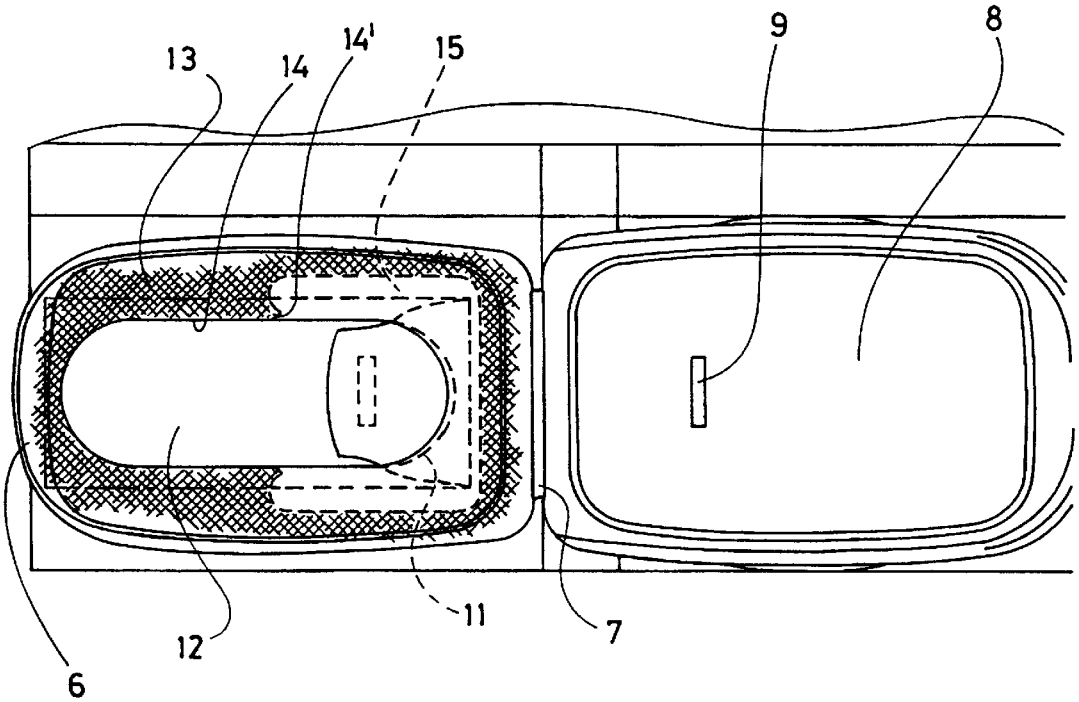
Fig. 4 B

OPENING ARRANGEMENT FOR PACKAGING CONTAINERS

TECHNICAL FIELD

The present invention relates to an opening arrangement for packaging containers, comprising a prefabricated outlet opening, a pull-tab which seals the outlet opening in liquid-tight fashion, a pouring device connected to the outside of the packaging container, and a closure device.

BACKGROUND ART

Opening arrangements of the above-outlined type are employed in, for example, that type of substantially parallelepipedic packaging container which is manufactured from paper/plastic laminate and which is generally encountered on the market as a package for, for instance, juice or other beverages. A packaging container with a previously known opening arrangement of this type is disclosed in, for example, European Patent Applications EP 93101724.8 and EP 94119148.8, to which reference is now made. The pouring device of the prior art opening arrangement comprises a pouring aperture and an edge region extending around the aperture, and at whose rear end the closure device is applied. The pouring device is permanently connected to the outside of the packaging container around an outlet opening provided in the packaging laminate, the area of the opening being considerably smaller than the area of the pouring opening. As a result, a part of the packaging laminate which is located around the outlet opening will be exposed and forms a sealing surface which is accessible via the pouring opening, which extends around the outlet opening, and which is intended for the pull-tab whose purpose is to seal the outlet opening in liquid-tight fashion. Thus, the pull-tab is not covered in any part by the pouring device or its edge region, which, in this design and construction, is a precondition for the consumer to be able to grasp and detach the pull-tab completely from the packaging container. The difference in area between the outlet opening and the pouring opening moreover permits a certain degree of tolerance in accuracy on application of the pouring device onto the outside of the packaging container, which takes place after the pull-tab has also been applied over the outlet opening.

The above-mentioned, projecting sealing surface for the pull-tab will, after removal of the pull-tab, prove a drawback since, on the one hand, it prevents the flow of contents out from the packaging container and, on the other hand, shows a tendency to attract droplets of the contents of the package when the consumer ceases pouring. Residual contents remaining around the outlet opening not only make an unfavourable impression but may also prove to be a difficulty in reclosing the packaging container, since it cannot be overlooked that contents might be splashed out in connection with the dosing operation. In addition, the necessary area difference between the outlet opening and the pouring opening makes it impossible to increase the area of the outlet opening above and beyond a certain limit, as may, for example, be desirable when more viscous products are to be packed in the packaging container and poured through the opening arrangement.

OBJECTS OF THE INVENTION

One object of the present invention is to realise an opening arrangement which obviates the above-outlined drawbacks and which makes it possible to increase the area of the outlet opening, and wholly or partly to reduce the size of the projecting sealing edge so that the risk of residual contents remaining on the opening arrangement is eliminated.

A further object of the present invention is to realise an opening arrangement which reduces the demands on accuracy and exactness in application of the pouring device onto the packaging container.

Yet a further object of the present invention is to realise an opening arrangement which displays greater tolerance to incorrect application of the pouring device, and ensures that the pull-tab may satisfactorily be removed without hindrance from the packaging container when this is to be opened.

SOLUTION

These and other objects have been attained according to the present invention in that an opening arrangement for packaging containers comprising a prefabricated outlet opening, a pull-tab sealing the outlet opening in liquid-tight fashion, a pouring device connected to the outside of the packaging container, and a closure device has been given the characterizing feature that a portion of the pull-tab extends in beneath the pouring device and is permanently sealed between the pouring device and the outside of the packaging container, the pouring device displaying a tear device for permitting severing of the pull-tab.

Preferred embodiments of the opening arrangement according to the invention have further been given the characterizing features as set forth in the appended subclaims.

ADVANTAGES

By causing the pull-tab to extend partially in beneath the pouring device, and by providing the pouring device with a tear device for permitting severing of the pull-tab, the demands on accuracy in the application of the pouring device are reduced considerably, at the same time as the need for a projecting laminate edge for securing the pull-tab is wholly or partly obviated. As a result, the application will be simpler and more reliable, at the same time as the function of the opening arrangement is guaranteed even further.

BRIEF DESCRIPTION OF THE ACCOMPANYING DRAWINGS

Preferred embodiments of the opening arrangement according to the present invention will now be described in greater detail hereinbelow, with particular reference to the accompanying, schematic Drawings which show only those details indispensable to an understanding of the present invention. In the accompanying Drawings:

FIGS. 1A, B, C and D show, in perspective and in steps the opening phase in a first embodiment of the opening arrangement according to the present invention;

FIGS. 2A and B show the first embodiment of the opening arrangement according to the present invention in cross section and in top plan view, respectively;

FIGS. 3A and B show a second embodiment of the opening arrangement according to the present invention in cross section and in top plan view, respectively; and FIGS. 4A and B show a third embodiment of the opening arrangement according to the present invention in cross section and in top plan view, respectively.

DESCRIPTION OF PREFERRED EMBODIMENTS

Figures 1A, 1B, 1C, 1D:
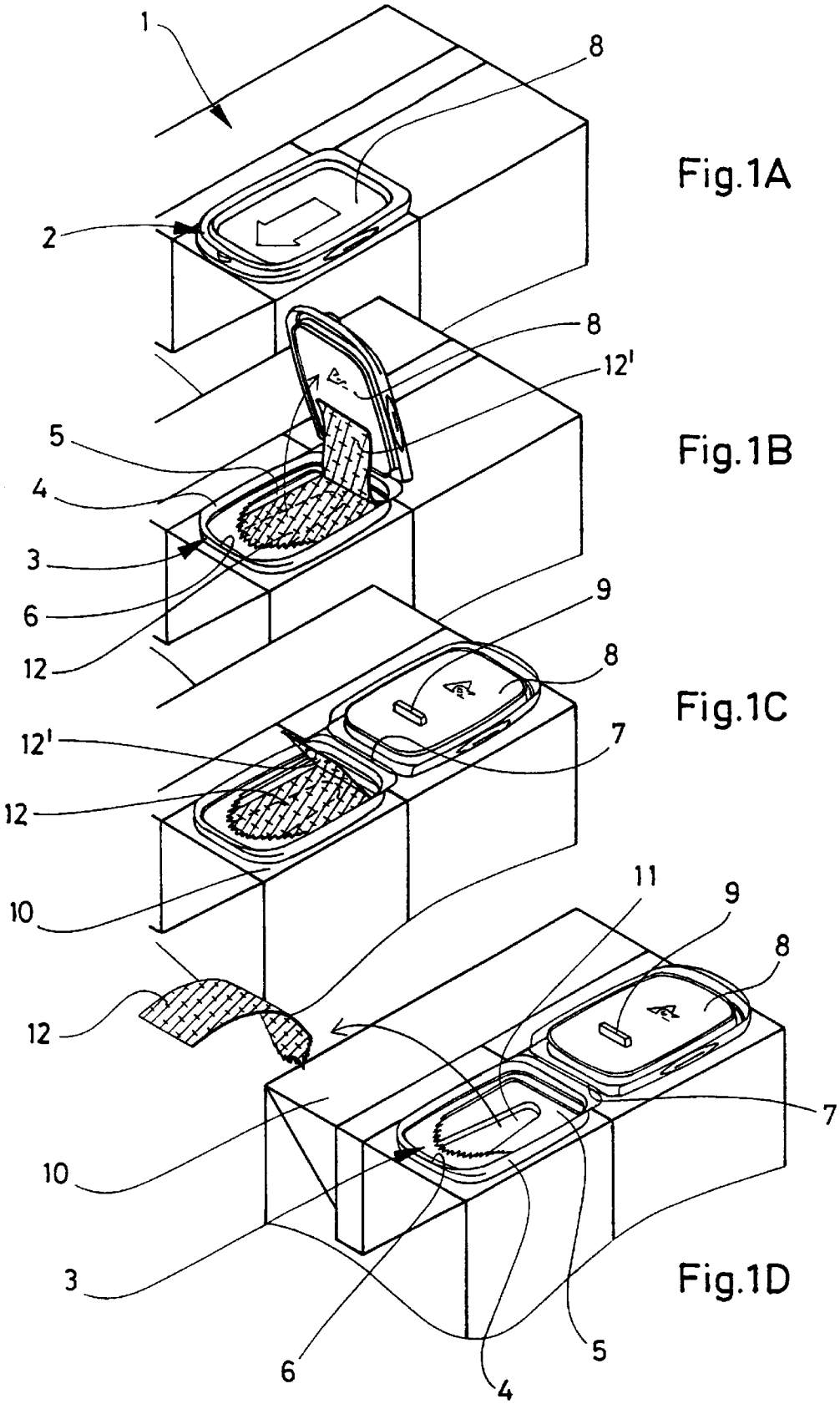

FIGS. 1A–D show the upper portion of a parallelepipedic packaging container of per se known type. This packaging container is marketed under the name Tetra Brik® and packaging containers of this type with previously known versions of opening arrangements are described in depth in European Patent Applications EP 93101724.8 and EP 94119148.8, to which reference is now made for further details. The packaging container proper does not form part of the present invention and it is presupposed that the opening arrangement according to the present invention may freely be employed in conjunction with both the illustrated type of packaging container and other suitable types of packaging containers which are wholly or partly manufactured from flexible materials, for example gable-top packages and can- or bottle-shaped packages of the single use disposable type. FIGS. 1A–D show the opening phase of the packaging container in steps, and although the illustrated packaging container is of a first embodiment, the opening procedure for the packaging containers according to the other embodiments of the present invention adhere to the same schematic pattern.

The packaging container 1 illustrated in FIG. 1 is provided with an opening arrangement 2 manufactured, for example, from injection moulded thermoplastic, the opening arrangement being shown in FIG. 1A in the applied and closed state, i.e. at the time when the packaging container 1 has not yet been opened by the consumer.

It will be apparent from FIG. 1B how the opening arrangement 2 includes a pouring device 3 with an edge region 4 which extends in annular form around a pouring opening 5. The pouring device 3 has a front portion provided with a pouring lip or edge 6, and a rear portion provided with a hinge 7. The hinge interconnects the pouring device 3 with a closure device 8 which, in FIG. 1B, is shown in the partly raised position. The closure device 8 is in the form of a lid whose inner surface displays a projection 9. It will also be apparent how a pull-tab 12 connected to both the upper wall 10 of the packaging container 1 and to the projection 9 is accessible to the consumer.

In FIG. 1C, the closure device has assumed its fully open position, and the pull-tab has begun to be detached from the projection 9 of the closure device 8.

It will be apparent from FIG. 1D how the pouring device 3 surrounds an outlet opening 11 provided in the upper packaging container wall 10 of the container, the area of the outlet opening 11 being considerably less than the area of the pouring opening 5 disposed in the pouring device 3. The difference in area thus exposes a part of the packaging container wall 10 surrounding the outlet opening 11, this part forming a projecting material edge which is surrounded by the edge region 4 of the pouring device 3. This material edge is utilised for fixedly sealing the pull-tab 12 whose outer width is such that it is accommodated with a certain tolerance within the pouring opening 5. The front end of the pull-tab extends in beneath and is fixedly sealed between the front end of the pouring device 3 and the upper side of the packaging container. The front end of the pouring device 3 displays a tear device 14 facing towards the pull-tab 12, as will be explained in greater detail hereinbelow. The rear end 12' of the pull-tab 12 is folded double and, in the closed position of the opening arrangement, is sealed to the projection 9 located on the inside of the lid (FIG. 1B).

When the packaging container is to be opened, the consumer takes a grip on the front end of the closure device or lid 8 and lifts the lid to the position illustrated in FIG. 1B. In such instance, the folded, rear portion 12' of the pull-tab 12 will (because of the connection with the projection 9 of the closure device 8) be raised up from its position abutting against the major portion of the pull-tab to that position which is illustrated in FIG. 1B, in which the rear strip portion 12' is stretched until the seal between the projection 9 and the folded portion 12' of the pull-tab is broken. Continued backward bending of the closure device 8 about the hinge 7 results in the position illustrated in FIG. 1C. In this position, the upwardly projecting rear end 12' of the pull-tab 12 will be readily accessible to the consumer who grasps the double-folded portion and pulls upwards, whereupon the seal between the pull-tab 12 and the laminate edge of the packaging container located in the pour opening is broken so that the outlet opening 11 is exposed. The front end of the pull-tab fixedly sealed beneath the front edge of the pouring device 3 is severed with the aid of the tear device 14 and remains in place on the packaging container. Hereafter, the consumer may pour out the desired quantity of the contents of the packaging container by suitable tilting of the container.

The various embodiments of the opening arrangement according to the invention comprise substantially the same parts as the above-disclosed, first embodiment of the opening arrangement, and corresponding parts have therefore been given the same reference numerals. All embodiments are illustrated in a position corresponding to that of FIG. 1C, i.e. with the closure device 8 bent backwards about the hinge 7 and with the pull-tab 12 in place.

As is apparent from FIGS. 2, 3 and 4, the opening arrangement according to the invention differs in a technically fundamental manner from the previously described opening arrangements of this type, by the fact that the covering strip or pull-tab 12 is no longer located in the wholly exposed position within the edge region 4 of the pouring device, but extends with a front portion in beneath this edge region 4 and is fixedly sealed between this region and the outside of the upper packaging container wall 10. Hereby, the requirement on accuracy will be reduced in respect of application of the pouring device 3, at the same time as the size of the exposed laminate edge surrounding the outlet opening 11 may be substantially reduced. Since the pull-tab 12 cannot in its entirety be removed from the packaging container in connection with its opening, the pouring device 3 displays means for facilitating severing or tearing of the strip in connection with opening of the packaging container, as will be described in greater detail hereinbelow, with individual reference to each one of the three described embodiments.

In FIGS. 2B, 3B and 4B, a shadowed region indicates the approximate extent of a seal 13 between the pouring device 3 and the upper side of the packaging container 1. The seal 13 consists, for example, of heat-sealable adhesive, so-called hot-melt, which was applied to the packaging container or pouring device and heated prior to their unification. It will also be apparent from the Drawing Figures how the front end of the pull-tab 12 extends in beneath the edge region 4 of the pouring device 3 and thus, with the aid of the above-mentioned seal 13, is permanently sealed between this edge region and the outside of the packaging container. The rear end of the pull-tab 12 provided with the double-folded portion 12' is, in all embodiments, wholly or partly exposed and is thus accessible to the consumer, as is further facilitated with the aid of the previously described connection with the projection 9 of the closure device 8 which, when the closure device 8 is raised, lifts the double-folded strip portion 12' to an easy-grip position.

At that part of the opening arrangement where the pull-tab extends in beneath the edge region 4 of the pouring device 3, this is provided with a tear device 14 so as to permit severing of the pull-tab 12 so that the free, released rear portion may be detached from the front end fixedly sealed to the packaging container. In the embodiment shown in FIGS. 2A and B, the tear device 14 is in the form of a toothed, substantially semi-circular region at a tapering, forward tearing portion of the otherwise uniformly wide pouring opening 5. In the second embodiment of the opening arrangement according to the present invention illustrated in FIGS. 3A and B, the pouring opening 5 and the surrounding seal 13 similarly display a forward, tapering tear portion at which the pull-tab 12 is sealed in between the pouring device 3 and the outside of the packaging container 1, as well as an access portion located at the opposite, rear part of the pouring device, the width of this portion exceeding the width of corresponding parts of the pull-tab 12. The double-folded portion 12' of the pull-tab is located wholly within the above-mentioned, wider access portion, for which reason it is easily accessible. At the transition between the wider access portion of the pouring opening and the narrower tearing portion, the tear device 14 is provided with two teeth 14' which are directed towards the access portion of the pouring opening 5. The tearing portion of the pouring opening 5 has been given a width that substantially corresponds to the width of the outlet opening 11.

The third version, illustrated in FIGS. 4A and B, of the opening arrangement according to the present invention corresponds, in certain parts, with the above-described second version. With a view to giving the opening arrangement a purer, more symmetric appearance, the access portion of the pouring opening 5 is, however, here in the form of a recess 15 which is of such height (exceeds twice the strip thickness) that it leaves a free space for the end of the pull-tab 12 provided with the double-folded portion 12'. The width of the recess 15 exceeds the width of the rear end of the pull-tab 12. The recess 15 will hereby be invisible to the consumer when the opening arrangement is viewed from above, since the visible part of the pouring opening 5 is of substantially the same (or slightly smaller) dimensions and configuration as the subjacent outlet opening 11.

When an opening arrangement according to the present invention is to be opened by the consumer, the procedure is followed in the manner as described with reference to the first embodiment of the opening arrangement illustrated in FIGS. 1A–D. In other words, the consumer grasps the forward edge of the closure device 8 or lid and lifts this upwards so that it pivots rearwardly about the hinge 7. Because of the connection between the projection 9 of the closure device 8 and the double-folded, rear portion 12' of the pull-tab 12, this is also lifted to the position illustrated in FIG. 1B, whereafter the seal between the strip and the projection 9 is broken so that the strip remains in this position. After return pivoting of the closure device 8 to the position illustrated in FIG. 1C, the consumer grasps the upwardly projecting, rear portion 12' of the pull-tab and pulls this upwards, whereupon the seal between the pull-tab and the upper side of the packaging material is broken so that the pull-tab accompanies this upward movement. When the rear portion of the pull-tab 12 has been pulled loose, further removal is prevented by that part of the edge region 4 of the pouring device 3 beneath which the front end of the pull-tab had been sealed. However, thanks to the tear device 14, the strip or tab may now be severed so that the portion not covered by the edge region 4 may be removed and thereby expose the outlet opening 11, while the fixedly sealed part remains in place beneath the portion of the pouring device 3 connected by the seal 13 to the upper side of the packaging container. In the first embodiment, illustrated in FIGS. 2A and B, this severing or separation of the pull-tab 12 takes place along the tapering tearing portion of the pouring opening provided with the teeth of the tear device 14, while, in the second and third embodiments shown in FIGS. 3 and 4, respectively, this separation is initiated by the teeth 14' of the tear device 14, whereafter the severing or separation runs along the possibly toothed edge serving as tear device 14 along the narrower, front end or tearing portion of the pouring opening 5. In the first and second embodiments (FIG. 2, FIG. 3), lifting of the double-folded rear portion 12' of the pull-tab 12 is effected in the same manner as in the previously known embodiments, while lifting of the double-folded pull-tab portion 12' in the third embodiment illustrated in FIG. 4 takes place in that the central section of the double-folded portion is raised with the aid of the projection 9 of the closure device 8 during simultaneous bending of the pull-tab 12 and pulling of the pull-tab partly out of the space created by the recess 15. When the folded pull-tab portion 12' is raised to such an extent that it is released from the projection 9, it will be located in the position illustrated in FIGS. 4A and 4B, i.e. in any event the central section is raised to such an extent that the consumer may simply grasp the end of the pull-tab and continue pulling the pull-tab in the same manner as was described in connection with FIG. 3. In the embodiment illustrated in FIG. 4, the teeth 14' are placed at the front end of the recess 15, i.e. at the transition to the tearing portion of the pouring opening 5.

Where opening devices of the described or other types are used it is known to improve the pouring by dividing an outlet opening into two parts, i.e. a bigger, forward pouring opening and a smaller, rewardly positioned inlet opening for air. Especially with completely filled packages this will improve the pouring ability, as the outflow of liquid does not prevent the inflow of air needed in order to avoid gulping. A similar arrangement can preferably be used in connection with the present invention, whereby especially the embodiment shown in FIG. 4 is advantageous, as the air inlet hole is possible to hide below the rear part of the recess 15, which if so desired could be prolonged in the rearward direction of the opening device, i.e. where the pull-tab is folded (the embodiment with air hole is not shown in the drawings). Obviously, the same pull-tab can be used to cover both the outlet opening and the airhole thus facilitating the opening manouvre for the consumer.

The fact that the airhole is hidden below the rear part of the pouring device 3 improves the appearance of the opening device without having any functionally negative influence and thus it presents a clearly positive addition to the earlier described embodiments of the present invention. Thus, it is to be understood that throughout the specification and claims the expression outlet opening is also intended to include also the above embodiment with a separate air hole as well as all intermediate versions with for example an outlet opening having an elongated, narrow rear end functioning as an air inlet.

In all embodiments according to the present invention, two essential advantages are thus afforded as compared with previously known similar types of opening arrangements. First, the previously high degree of accuracy in the application of the injection moulded pouring device over the pull-tab is no longer necessary, since the pull-tab need not be wholly exposed and accessible within the pouring opening. Application is hereby greatly facilitated and application speed in production may thereby be increased. Secondly, the present invention affords the advantage that the projecting edge of packaging material in the pouring opening disappears, in any event at the front end (the tearing end) of the pouring opening, where the risk is greatest that the edge will entrap droplets of the contents of the package after the pouring operation is completed. As a result, the opening arrangement will also have a more attractive appearance, as is particularly apparent in the embodiment illustrated in FIG. 4.

The present invention should not be considered as restricted to that described above and shown on the Drawings, many modifications being conceivable without departing from the spirit and scope of the appended claims.

What is claimed is:

1. An opening arrangement for packaging containers, comprising: a packaging container, a prefabricated outlet opening, a pull-tab which seals the outlet opening in liquid-tight fashion, a pouring device connected to an outside of the packaging container, and a closure device, wherein the pull-tab extends with a portion underneath the pouring device and is fixedly sealed between the pouring device and the outside of the packaging container, the pouring device including a tear device for permitting severing of the pull-tab.

2. The opening arrangement as claimed in claim 1, wherein the pouring device has an elongate pouring opening and displays a front portion serving as pouring edge or lip, and an opposed, rear portion, the tear device being located at the front portion.

3. The opening arrangement as claimed in claim 2, wherein the pouring device is sealed to the outside of the packaging container in a seal which extends along the pouring opening and which, at the front end of the pouring device, displays a tapering portion at which the pull-tab is sealed in between the pouring device and the outside of the packaging container.

4. The opening arrangement as claimed in claim 3, wherein the seal at the opposite end of the pouring device displays a wider portion whose width exceeds the width of a corresponding part of the pull-tab.

5. The opening arrangement as claimed in claim 4 to wherein a side of the pouring device facing towards the packaging container displays, at the access portion, a recess whose height is equal to or higher than twice the thickness of the pull-tab, and whose width exceeds the width of a corresponding portion of the pull-tab.

6. The opening arrangement as claimed in claim 3, wherein the tear device includes two or more teeth, which are placed at the edge of the pouring device (3) facing towards the outlet opening.

7. The opening arrangement as claimed in claim 6, wherein the teeth are located at the transition between a front tearing portion and a rear access portion in the pouring opening.

8. The opening arrangement as claimed in claim 5, wherein the teeth are directed towards the access portion of the pouring opening.

9. The opening arrangement as claimed in claim 1, wherein the edge of the pouring device facing towards the outlet opening is designed with a toothing which extends along that part of the pouring device at which the pull-tab is sealed in between the pouring device and the outside of the packaging container.

10. The opening arrangement as claimed in claim 1, wherein the closure device is connected to the rear portion of the pouring device by means of a hinge.

11. An opening arrangement for packaging containers, comprising: a packaging container, a prefabricated outlet opening, a pull-tab which seals the outlet opening in liquid-tight fashion, a pouring device connected to an outside of the packaging container, and a closure device, wherein the pull-tab extends with a portion underneath the pouring device and is fixedly sealed between the pouring device and the outside of the packaging container, the pouring device displaying a tear device for permitting severing of the pull-tab, wherein the edge of the pouring device facing towards the outlet opening is designed with a toothing which extends along that part of the pouring device at which the pull-tab is sealed in between the pouring device and the outside of the packaging container.

12. An opening arrangement for packaging containers, comprising: a packaging container, a prefabricated outlet opening, a pull-tab which seals the outlet opening in liquid-tight fashion, a pouring device connected to an outside of the packaging container, and a closure device, wherein the pull-tab extends with a portion underneath the pouring device and is fixedly sealed between the pouring device and the outside of the packaging container, the pouring device displaying a tear device for permitting severing of the pull-tab, the pouring device having an elongate pouring opening and displaying a front portion serving as a pouring edge or lip, and an opposed, rear portion, the tear device being located at the front portion.

13. The opening arrangement as claimed in claim 12, wherein the pouring device is sealed to the outside of the packaging container in a seal which extends along the pouring opening and which, at the front end of the pouring device, displays a tapering portion at which the pull-tab is sealed in between the pouring device and the outside of the packaging container.

14. The opening arrangement as claimed in claim 13, wherein the seal at the opposite end of the pouring device displays a wider portion whose width exceeds the width of a corresponding part of the pull-tab.

15. The opening arrangement as claimed in claim 14, wherein a side of the pouring device facing towards the packaging container displays, at the access portion, a recess whose height is equal to or higher than twice the thickness of the pull-tab, and whose width exceeds the width of a corresponding portion of the pull-tab.

16. The opening arrangement as claimed in claim 13, wherein the tear device includes two or more teeth, which are placed at the edge of the pouring device facing towards the outlet opening.

17. The opening arrangement as claimed in claim 16, wherein the teeth are located at the transition between a front tearing portion and a rear access portion in the pouring device.

18. The opening arrangement as claimed in claim 17, wherein the teeth are directed towards the access portion of the pouring device.

* * * * *